US005118259A

United States Patent [19]

Bishoff

[11] Patent Number: 5,118,259

[45] Date of Patent: Jun. 2, 1992

[54] SYSTEM FOR CONTROLLING OIL VISCOSITY

[75] Inventor: David R. Bishoff, Stevens Point, Wis.

[73] Assignee: Woodward Governor Company, Stevens Point, Wis.

[21] Appl. No.: 602,712

[22] Filed: Oct. 24, 1990

[51] Int. Cl.[5] ..... F04B 49/00

[52] U.S. Cl. ..... 417/18; 417/28; 417/32; 60/329

[58] Field of Search ..... 417/18, 32, 26, 27, 417/28; 60/329

[56] References Cited

U.S. PATENT DOCUMENTS

| | | | |
|---|---|---|---|
| 3,530,958 | 9/1970 | Brannon et al. | 60/329 |
| 4,373,869 | 2/1983 | Martin et al. | 60/329 |
| 4,951,466 | 6/1989 | Macht | 60/329 |

FOREIGN PATENT DOCUMENTS

| | | | |
|---|---|---|---|
| 438615 | 11/1935 | United Kingdom | 60/329 |

OTHER PUBLICATIONS

U.S. patent application Ser. No. 07/602,717 filed Oct. 24, 1990.

*Primary Examiner*—Leonard E. Smith
*Attorney, Agent, or Firm*—Leydig, Voit & Mayer

[57] ABSTRACT

A system for and a method of establishing and maintaining fluid at desired viscosity and temperature levels in a flow system. The system includes a driven pump that circulates fluid from a fluid source through a hydraulic loading system that includes an unloading valve. As fluid flows through the valve, a pressure drop is created across the valve operator, which restricts flow through the valve. This pressure drop across the valve operator results in the dissipation of heat, increasing the temperature of the fluid flowing through the valve. During operation of the system, if a low temperature condition is sensed in the system, power will be supplied to the pump, which pumps fluid through the valve at a controlled low pressure drop to result in a controlled heating of the fluid. When the fluid is restored to a desired temperature level, power to the pump is discontinued to terminate flow through the valve. The level of heat produced in the fluid may be adjusted by adjusting the degree that the pressure drops as the fluid flow through the valve. This is accomplished by adjusting the degree of the restriction to flow across the valve operator.

37 Claims, 8 Drawing Sheets

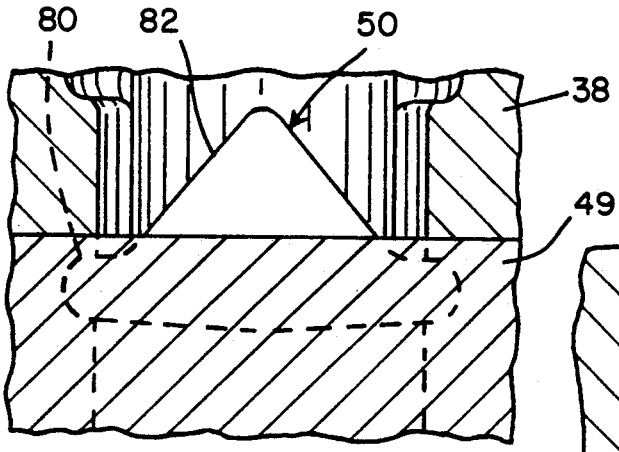
FIG. 7
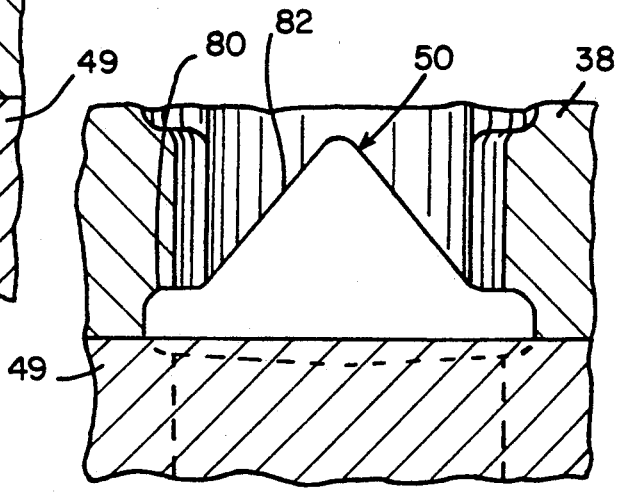
FIG. 8
| FLOW RELATED SETTING | | | |
|---|---|---|---|
| FLOW GPM | WASHER ON TOP | WASHER ON BOTTOM | GAP |
| 10 | 10 | 0 | 2.413 |
| 20 | 10 | 0 | 2.300 |
| 30 | 10 | 0 | 2.212 |
| 40 | 10 | 0 | 2.136 |
| 50 | 0 | 10 | 2.001 |
| 60 | 1 | 9 | 1.934 |
| 70 | 2 | 8 | 1.872 |
| 80 | 2 | 8 | 1.814 |
| 90 | 3 | 7 | 1.760 |
| 100 | 3 | 7 | 1.706 |
| 120 | 4 | 6 | 1.611 |
| 140 | 5 | 5 | 1.523 |
| 160 | 6 | 4 | 1.460 |
| 180 | 7 | 3 | 1.365 |
| 200 | 8 | 2 | 1.221 |
FIG. 9

SYSTEM FOR CONTROLLING OIL VISCOSITY

FIELD OF INVENTION

The invention relates generally to hydraulic systems, and more specifically to flow control valves.

BACKGROUND OF THE INVENTION

Viscosity is one of the most important properties of hydraulic fluid in a fluid power system. Viscosity is a measure of the resistance of the fluid to flow, or, in other words, the sluggishness with which the fluid moves. When the viscosity is low, the fluid is thin and has a low body; consequently, the fluid flows easily. Conversely, when the viscosity is high, the fluid is thick in appearance and has a high body; thus, the fluid flows with difficulty.

Maintaining the hydraulic fluid at the ideal viscosity for a given hydraulic system is an important feature of ensuring efficient operation of the system. If the viscosity of the fluid is too high, the system will operate sluggishly and consume greater amounts of power due to this higher resistance to flow. A higher viscosity also tends to inhibit the proper release of entrapped air from the oil. This entrapped air, which causes the oil to appear foamy, tends to reduce the bulk modulus of the oil so that the oil behaves in a "spongy" manner. Utilization of oil having a lower bulk modulus also increases the noise levels of the pump and valves, and decreases the stability of the operation valves and servo control systems. In addition, oil having trapped air can cause premature damage to pumps as a result of cavitation and microscopic burning of the oil as the air bubbles pass from the inlet to the outlet of the pump.

Additionally, high fluid viscosity will result in increased pressure drop through valves and lines. Conversely, too low of a fluid viscosity will result in increased leakage losses past the seals, and excessive wear due to the breakdown of the oil film between moving parts.

Hydraulic fluid, such as oil, becomes thicker, or more viscous, as the temperature decreases, and thinner, or less viscous, when heated. Thus, changes in temperature can have a significant affect on viscosity, and, therefore, efficient operation of the components of the hydraulic system. Further, excessive temperature hastens oxidation of hydraulic oil and causes it to become too thin. This promotes deterioration of seals and packings, and likewise accelerates wear between closely fitting parts of hydraulic components of valves, pumps, and actuators. Conversely, when the fluid is at an optimum temperature, it will exhibit enhanced air release and display a desirable increased fluid bulk modulus. The high fluid bulk modulus, or, in other words, the incompressibility of the fluid at the optimum temperature provides the highly favorable stiffness of hydraulic systems that makes them the frequent choice for many high-power applications.

Changes in the temperature that affect the operation of the hydraulic system may be caused by environmental conditions, or by heat generated in the system itself. Significant sources of heat in the hydraulic loading system include the pump, pressure relief valves, and flow control valves. The operation of the hydraulic system, whether the loading system is operating in a continuous or cyclic mode, may result in undesirable fluid temperature and viscosity characteristics. When the pump is operating in a continuous mode, the constant circulation of fluid, even at low flow rates, may result in an undesirable increase in fluid temperature, or over-temperature condition, and a corresponding decrease in fluid viscosity. Further, when the fluid is stagnant, as between cycles when the pump is operating in the cyclic mode, the fluid may fall below the optimum temperature level, with a corresponding increase in viscosity. Therefore, when the demands of equipment connected to the pump are light, the viscosity will be high, whereas increased usage of the same system results in decreased viscosity.

A common method of maintaining a desired steady-state temperature and, therefore, viscosity of the hydraulic fluid is to use heat exchangers. Heat exchangers are generally in the form of coolers or heaters that may be interposed in the system to increase the heat dissipation rate or the heat generation rate, respectively. Systems using such heat exchangers have a number of disadvantages. Local oil heaters, which usually employ electrical heating elements, tend to be fairly heat intensive and may tend to burn oil. Cooling is generally accomplished with water to oil heat exchangers. If water from this type of cooler leaks into the oil, major problems may result in the hydraulic system.

Further, such heat exchanges are additional components that are generally associated with a dedicated heating or cooling system. As a result, the use of heat exchangers adds to the overall cost and complexity of the hydraulic system, requiring additional hardware, controls, and operator time to monitor, control, and maintain the equipment. Because the use of heat exchangers may be dictated by the environment in which a system will operate, systems are often designed for use in specific applications. For example, heaters rather than coolers are typical in mobile hydraulic equipment that is required to operate in sub-zero temperatures, whereas coolers may be required in a system that operates continuously in a warm environment. Alternately, a hydraulic system that operates intermittently or more heavily at times may require multiple heat exchangers. For example, at times when the system operates infrequently, as when the demands by the connected system are light, the viscosity will be high, consequently requiring heaters to reduce the viscosity to an appropriate level. Conversely, when the demands of the connected system are heavy, the hydraulic system may be used more often, or even continuously, resulting in lower viscosity fluid. In this way, the same system may require coolers to increase the viscosity of the fluid. Thus, the use of heat exchangers contributes to the overall cost, complexity, and physical size of a hydraulic system.

OBJECTS OF THE INVENTION

It is a primary object to provide an economical, reliable, uncomplicated hydraulic system which maintains the hydraulic fluid at the ideal temperature and viscosity levels to provide efficient operation of the hydraulic components of the system. A related object is to eliminate the need for auxiliary heat exchangers and heat exchange systems to control the temperature and viscosity of the hydraulic fluid.

Other objects are to provide a system having enhanced system performance, reduced levels of entrapped air in the fluid, and minimal leakage losses past seals. Yet another object is to provide a system which exhibits minimal deterioration and wear of hydraulic components of the system.

A further object is to provide a system that evenly heats the fluid and may be adjusted to provide a desired level of heat output. A related object is to provide a hydraulic system that can be used in many different environmental locations.

SUMMARY OF THE INVENTION

In accomplishing these objectives in accordance with the invention, there is provided a system for and a method of establishing and maintaining fluid at desired viscosity and temperature levels in a flow system by utilizing a valve. The system includes a driven pump that circulates fluid from a fluid supply through a hydraulic system having various components, including at least one valve and piping. The system further includes a temperature sensor that is coupled to the pump. The valve comprises a valve body having an inlet and an outlet, and a valve operator, which restricts flow through the body. As fluid flows through the valve, this restriction to flow results in a pressure differential across the valve operator. According to accepted fluid flow principles, as a result of this pressure drop across the valve, or, in other words, the increase in pressure along the inlet side of the valve, energy will be dissipated in the form of heat, which results in an increase in the temperature of the fluid flowing through the valve. Thus, operation of the system at a relatively low pressure differential, as when the valve is operating in an unloaded condition, results in a controlled increase in fluid temperature. During operation, when the temperature sensor senses that the fluid has reached the required temperature point to obtain a desired viscosity level, the pump is de-energized to terminate flow through the valve. The level of heat produced in the fluid may be adjusted by adjusting the degree that the pressure drops as it flows through the valve. This is accomplished by adjusting the degree of restriction to flow through the valve itself. As the restriction increases, the heat dissipation, and, therefore, the temperature of the fluid increases.

Inasmuch as control of the fluid temperature and viscosity levels is dependent upon flow through the components of the system itself, this eliminates the need for auxiliary heat exchangers. Furthermore, the fluid temperature and viscosity control system may utilize a valve that performs one or more additional functions in the hydraulic system This utilization of a multi-purpose valve along with the system adjustability results in certain economies in both manufacture and stock keeping. Furthermore, the system and method of operating the system are reliable and uncomplicated. The utilization of fluid at ideal temperature and viscosity levels allows the components of the hydraulic system to operate efficiently with low levels of entrapped air, reduced power consumption, and minimal leakage losses past seals. This efficient operation results in minimal deterioration and wear of the hydraulic components themselves, extending the life of the components and reducing maintenance costs and system downtime. Additionally, as the level of heat output may be easily adjusted, a single system may be utilized in many environmental locations.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 7 is a fragmentary view of the unloading valve taken along line 7—7 in FIG. 5, wherein the valve is set up for relatively low flow rates.

FIG. 8 is a fragmentary view of the unloading valve taken along line 8—8 in FIG. 5, wherein the valve is set up for relatively high flow rates.

FIG. 9 is a chart of flow related settings for set up of the unloading valve.

DETAILED DESCRIPTION OF THE PREFERRED EMBODIMENTS

While the invention will be described and disclosed in connection with certain preferred embodiments and procedures, it is not intended to limit the invention to those specific embodiments. Rather it is intended to cover all such alternative embodiments and modifications as fall within the spirit and scope of the invention as defined in the appended claims.

Figure 1:
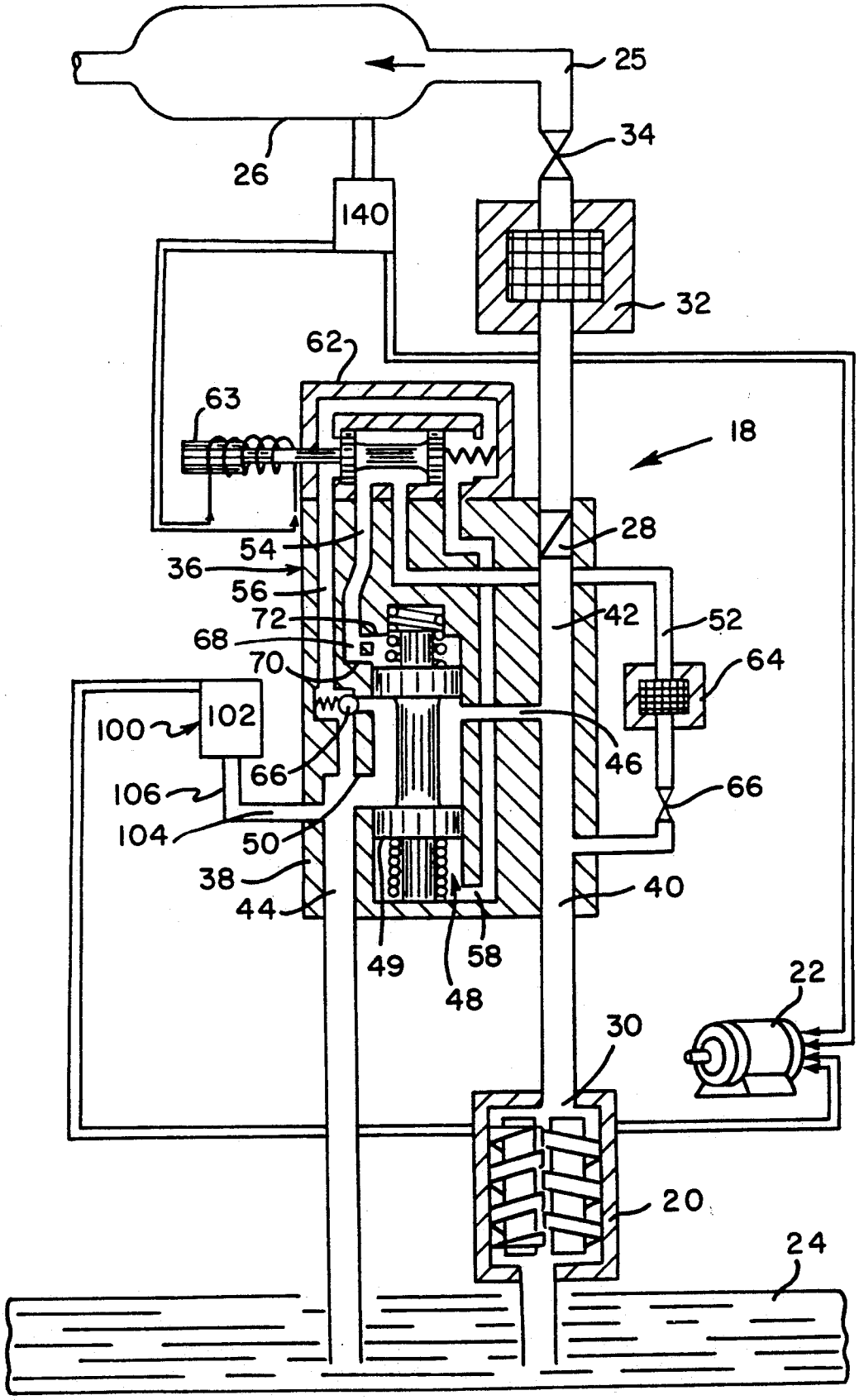
FIG. 1 is a schematic of the hydraulic fluid supply system in an unloaded position, with the directional control valve in the first position.

Turning now to the drawings, FIG. 1 shows a schematic of a hydraulic fluid supply system 18 exemplifying the present invention. It will be appreciated that the supply system 18 shown may be one of a number of such systems in a hydraulic fluid control system. It will further be appreciated that, while the invention is described in connection with a specific type of valve, more particularly, an unloading valve, it is equally applicable to alternate types of valves wherein a flow restriction within the valve results in a pressure drop across the valve, as explained below. An oil pump 20, which is usually powered by a motor 22, supplies high pressure hydraulic fluid from a fluid supply source, such as a sump 24, to a high pressure outlet 25. The outlet furnishes hydraulic fluid under pressure to a load, such as an accumulator 26. A one-way check valve or spring-loaded poppet valve 28 interposed in the line between the pump 20 and the high pressure outlet 25 insures that fluid flowing from the pump outlet 30 reaches a desired pressure level before flowing to the high pressure load 26. One or more filters 32 may be interposed in the line between the sump 24 and the high pressure load 26 to insure that the hydraulic fluid contains no impurities that would damage the hydraulic system or cause it to malfunction. A valve 34, which is in a normally open position when the particular supply system is in use, disposed between the one-way check valve 28 and the high pressure load 26 may be closed when the particular supply system 18 is not being utilized.

Figure 2:
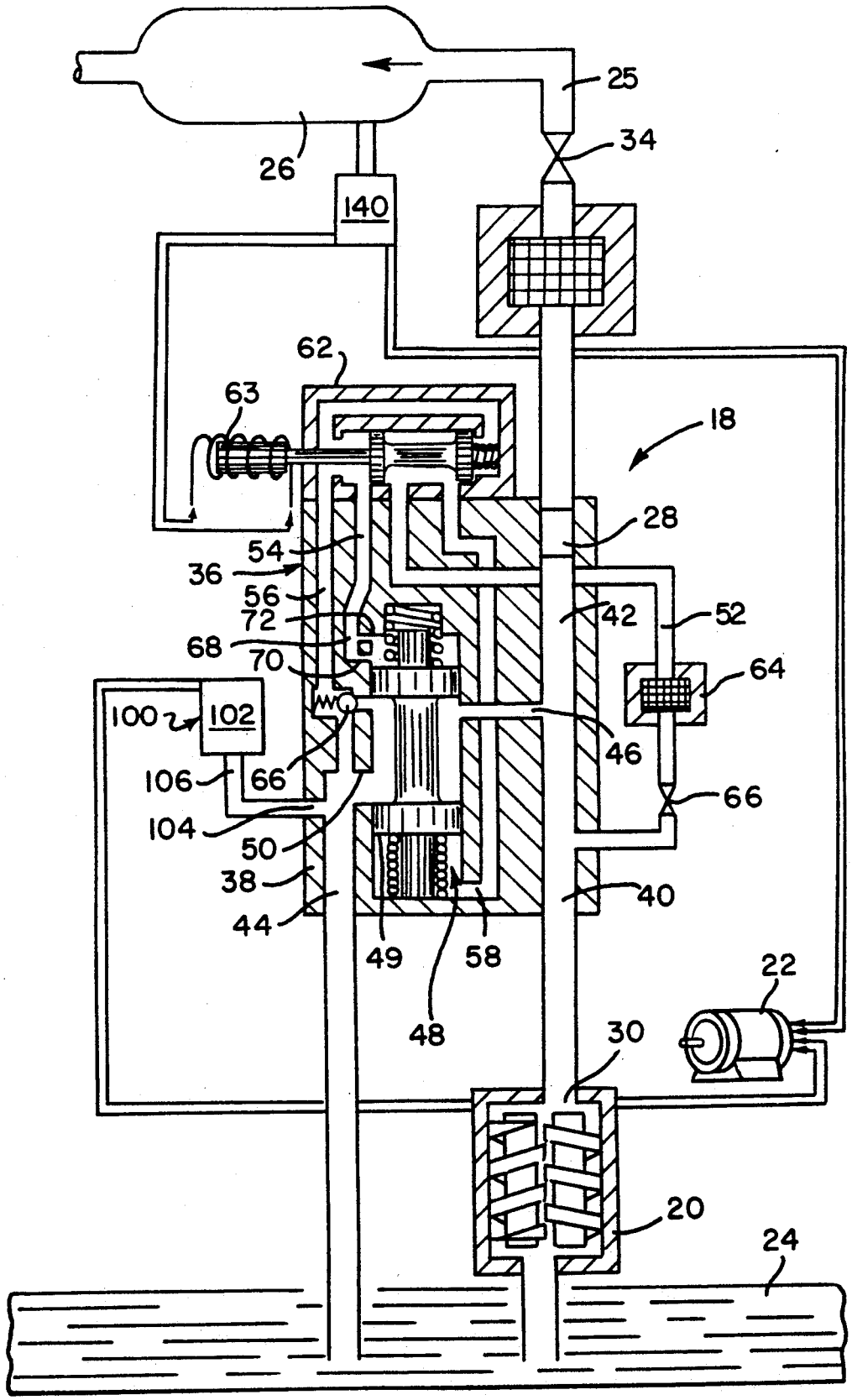
FIG. 2 is the schematic of the system of FIG. in an unloaded position with the directional control valve in the second position.
Figure 3:
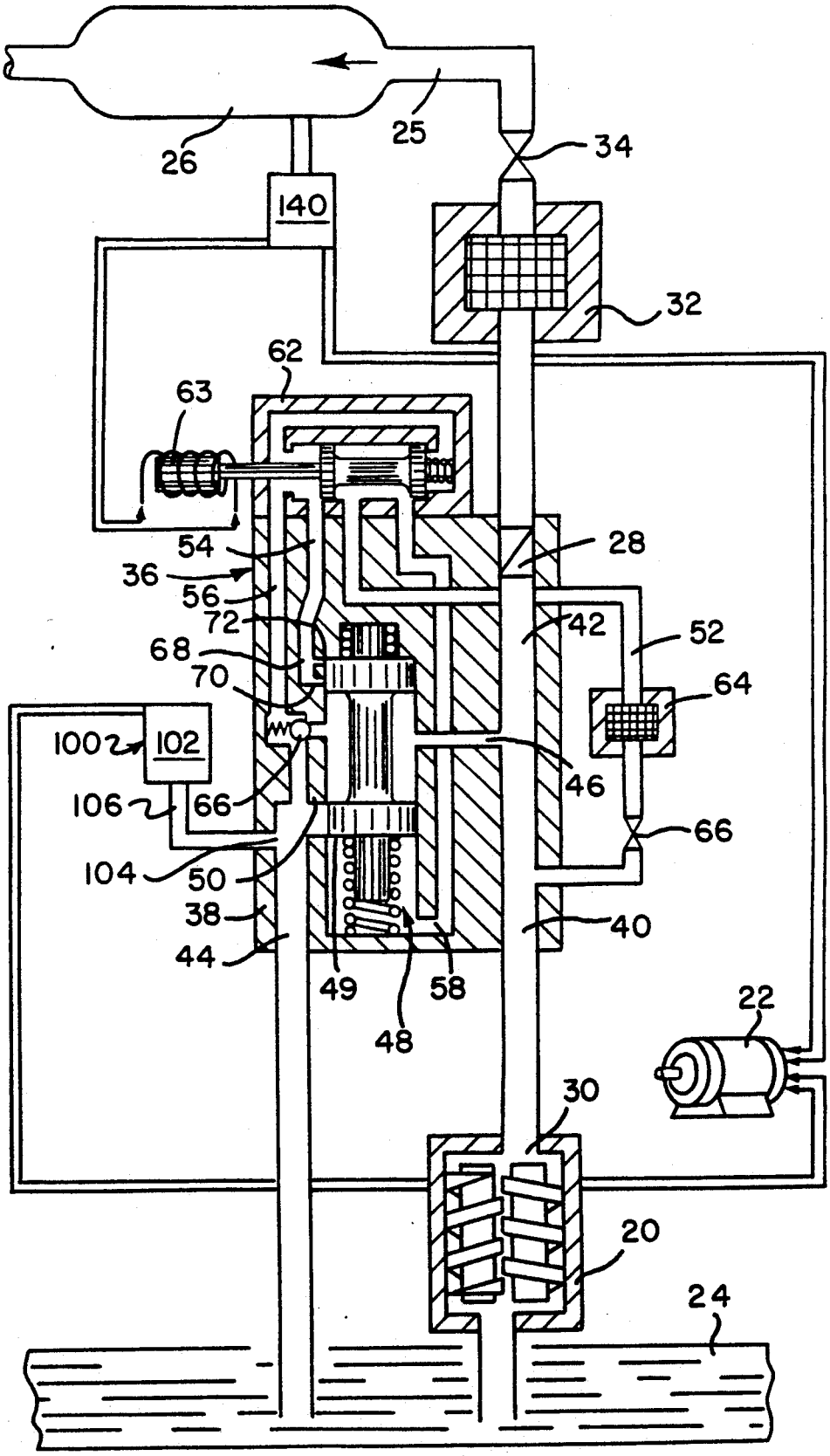
FIG. 3 is the schematic of the system of FIG. 1 in a loaded position with the directional control valve in the second position.
Figure 4:
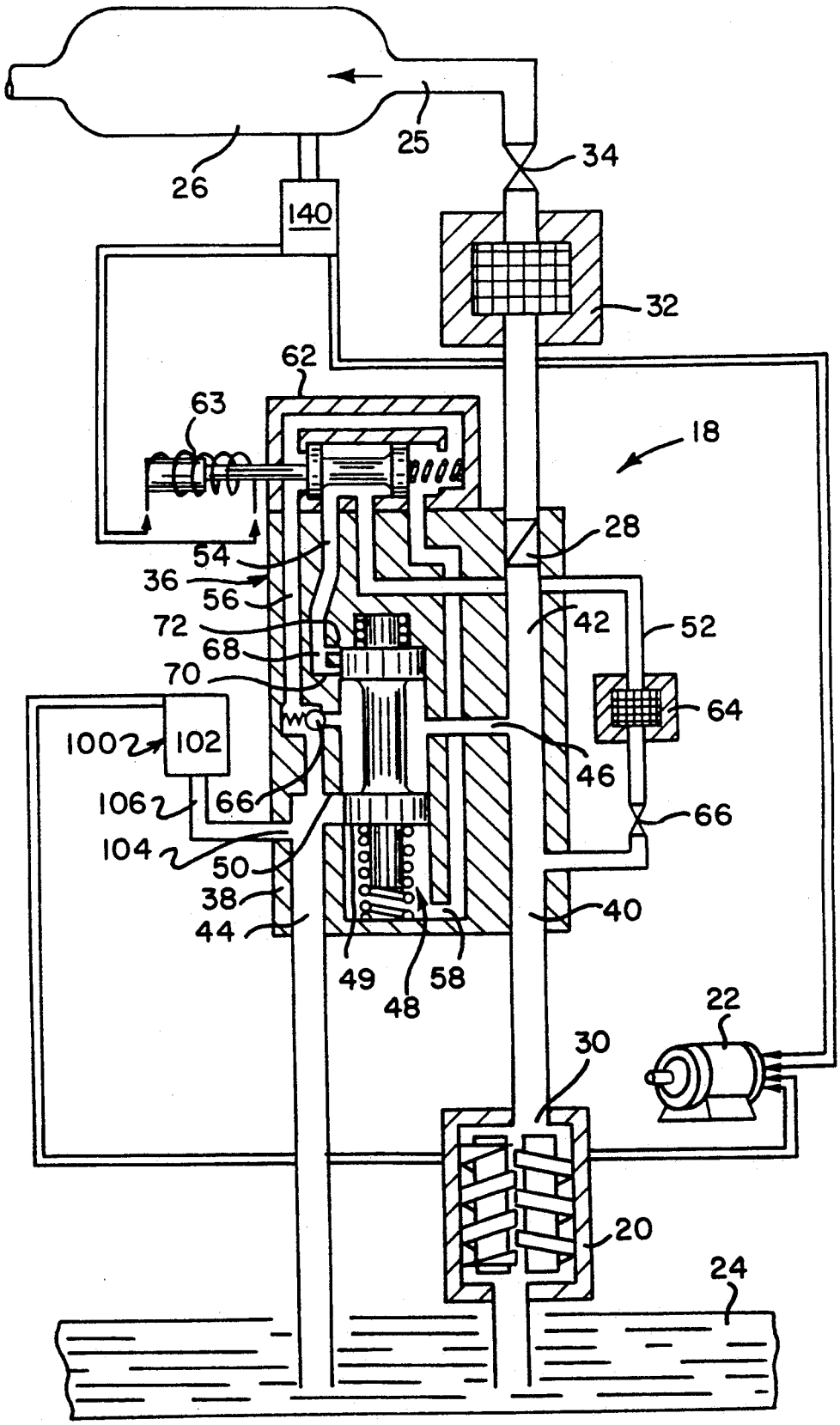
FIG. 4 is the schematic of the system of FIG. 1 in a loaded position with the directional control valve in the first position.

The system 18 may utilize a variable or fixed displacement pump 20 that comes up to speed in a finite time with fluid flow impelled by the pump 20 also increasing during that interval. In a preferred embodiment of the invention, a fixed displacement pump is utilized. In many cases, it is desirable to limit the load on the pump 20 during this start up interval. In order to allow the pump 20 to come up to speed at a light load before the high pressure load 26 is placed on the system 18 or develop sufficient pressure to supply the high pressure load 26, an unloading valve 36 is interposed between the pump 20 and the load 26. While in this example, the one-way check valve 28 is an integral part of the valve 36, it is not necessarily a requirement of the invention. The valve 36 includes a valve body 38 having an inlet 40, a working outlet 42, and a bypass outlet 44. When the pump 20 is in an unloaded condition, fluid enters the valve 36 through the inlet 40 and exits through the bypass outlet 44. As shown in FIGS. 1 and 2, fluid from the inlet 40 flows through line 46, a valve operator (designated generally as 48), such as a piston type valve having a spool 49, and the bypass outlet 44 to the sump 24. When the pump 20 has developed sufficient pressure, the spool 49 is caused to move axially to close off the bypass port 50 and prevent flow from exiting the valve 36 through the bypass outlet 44, as shown in FIGS. 3 and 4. As a result, flow entering the valve 36 is forced to exit through the working outlet 42 and the one-way check valve 28 to the high pressure outlet 25.

When normal fluid pressure of a desired minimum is re-established in the accumulator or load 26, or it otherwise is desirable to de-energize the motor 22 or unload the pump 20, the spool 49 is caused to slide axially in the opposite direction, moving the valve operator 48 from the loaded condition shown in FIGS. 3 and 4 to the unloaded position shown in FIGS. 1 and 2, once again allowing flow through the valve 36 via the bypass outlet 44 to the sump 24. Once the pump 20 is fully unloaded, the pump 20 and motor 22 may be deenergized without shock to the system. Alternately, the pump 20 may continue to run to circulate the fluid through the unloader valve 36.

In accordance with the invention, a system for and a method of establishing and maintaining fluid at desired viscosity and temperature levels in the flow system is provided wherein a driven pump circulates fluid from a fluid supply through a hydraulic system that includes at least one valve. The valve comprises an inlet, an outlet, and a valve operator, which restricts fluid flow through the body. While the invention is described with reference to an unloading valve, it will be appreciated that an alternate type of valve having an inlet, an outlet, and a restrictive valve operator could alternately be utilized. As fluid flows through the valve, a pressure differential is created across the valve operator. In accordance with accepted fluid flow principles, this pressure differential results in the dissipation of energy, resulting in an increase in the temperature of the fluid flowing through the valve. This increase in fluid temperature results in a corresponding decrease in the viscosity of the fluid. According to an important aspect of the invention, the heat produced in the fluid may be adjusted by adjusting the degree to which the valve operator restricts flow through the valve. Greater amounts of heat will be produced in the fluid as the pressure drop across the valve is increased due to increased flow restriction. To provide a desired viscosity level by providing a desired temperature range of the fluid, a temperature sensor, which is coupled to the pump, is disposed to sense the temperature of the fluid in the system. During operation, the valve is operated in a substantially unloaded condition to obtain a desired pressure drop, and, consequently, a controlled level of heat generation. When the temperature sensor senses that the fluid has reached the required temperature to obtain a desired viscosity level, the pump is de-energized to terminate flow through the valve.

Turning now to the drawings, the invention may be described with respect to an unloading valve 36, such as the one disclosed in the figures and described in greater detail in copending application Ser. No. 602,717 filed Oct. 24, 1990. While the invention is described with respect to the illustrated unloading valve 36, it will be appreciated that the invention is equally applicable to any type of valve in which a controlled pressure drop may be obtained across the valve to result in a controlled increase in fluid temperature. In the unloading valve 36 illustrated, flow through the unloading valve 36 serves as the actuating force for operation of the valve operator 48. The force created due to the flow through the inlet 40 of the valve 36 to the bypass outlet 44 may be controllably applied across the valve operator 48 to move the valve operator 48 from an unloaded condition, as shown in RIGS. 1 and 2, to a loaded condition, as shown in FIGS. 3 and 4. Likewise, the force created due to the flow through the inlet 40 of the valve 36 to the working outlet 42 may be controllably applied across the valve operator 48 to move the valve operator 48 from a loaded condition, as shown in FIGS. 3 and 4, to an unloaded condition, as shown in FIGS. 1 and 2.

It will be appreciated that the operating force may also be described in terms of pressure created by the flow form the pump 20. All other forces being substantially equal, when this pressure, which is applied to one end of the valve operator 48, is greater than the pressure applied to the opposite end of the valve operator 48, the valve 36 will transfer from either the unloaded to the loaded condition, or the loaded to the unloaded condition. While the invention may be described in terms of pressure, it will be appreciated that the invention could likewise be described in terms of forces applied to the valve operator 48.

According to an important aspect of the invention, when the loading system 18 is operating in a cyclic or automatic mode, the pump 20 may be energized to provide flow through the valve 36 when temperature or pressure controls (which are described below in grater detail) sense either low temperature condition in the supply fluid or a low pressure condition in the accumulator tank 26. It will likewise be appreciated that the loading system 18 can operate in a continuous or manual mode, continuously circulating the fluid through the loading system 18. In describing the invention, the operation of the unloading valve 36, as illustrated in FIGS. 1-4, will described with reference to its automatic operation, first, when a low pressure condition is sensed, and, second, when a low temperature condition is sensed. The components of the valve 36 are additionally described with reference to FIGS. 5-8; further details of the structure and operation of the valve 36 are disclosed, in copending application Ser. No. 602,717, filed Oct. 24, 1990. Finally, the overall operation of the system will be described with reference to the system representation shown in FIG. 11.

As shown in FIG. 1, the flow progresses from the inlet 40, through the valve operator 48 to the bypass outlet 44. The resulting pressure drop is communicated to the valve spool 49 by lines 52 and 54. The opposite end of the spool 49 communicates with the bypass outlet 49 through lines 56 and 58. In order to provide a flow connection between the lines 52, 54, 56, 58, a directional control valve 62 is provided. In the embodiment exemplified in FIGS. 1–4, a solenoid 63 operated four-way valve 62 is utilized to direct the flow to the ends of the valve operator 48. As shown in FIG. 1, the solenoid 63 operated valve 62 is in its de-energized position, directing pressure from the inlet 40 through the lines 52 and 54 to the upper end of the spool 49, and also connecting an outlet path from the lower end of the spool 49 through the lines 56 and 58 to the bypass outlet 44. In order to prevent impurities in the fluid exiting the pump 20 from interfering with the smooth operation of the directional control valve 62 and the valve operator 48, a filter 64 is interposed in line 52. Line 52 is also provided with a valve 66 that is normally set in the open position. Although the invention is described in terms of pressures at the inlet 40 and the bypass outlet 44 (i.e., a double-acting arrangement), alternate arrangements are contemplated. For example, the pressure created at the inlet 40 could be directed to one end of the valve operator 48, and the opposite end could be connected directly to a drain, such as with a single-acting operator or the like.

During operation in the automatic mode, when automatic controls (described below) sense a low pressure condition in the accumulator tank 26, the controls begin the pumping cycle by energizing the motor 22, which rotates the pump 20 to begin pumping fluid from the sump 24 to the unloading valve 36. The electrical solenoid 63 is likewise energized to move the valve 62 to its alternate condition, as shown in FIG. 2. It will be appreciated that circuitry may be provided to energize the solenoid 63 at approximately the same time as power is supplied to the pump 20. In this way, the solenoid 63 operated valve 62 connects the bypass outlet 44 to the upper end of spool 49 by way of lines 56 and 54, and connects the valve inlet 40, and, therefore, the pump outlet 30 to the lower end of the spool 49 by way of lines 52 and 58.

Figure 5:
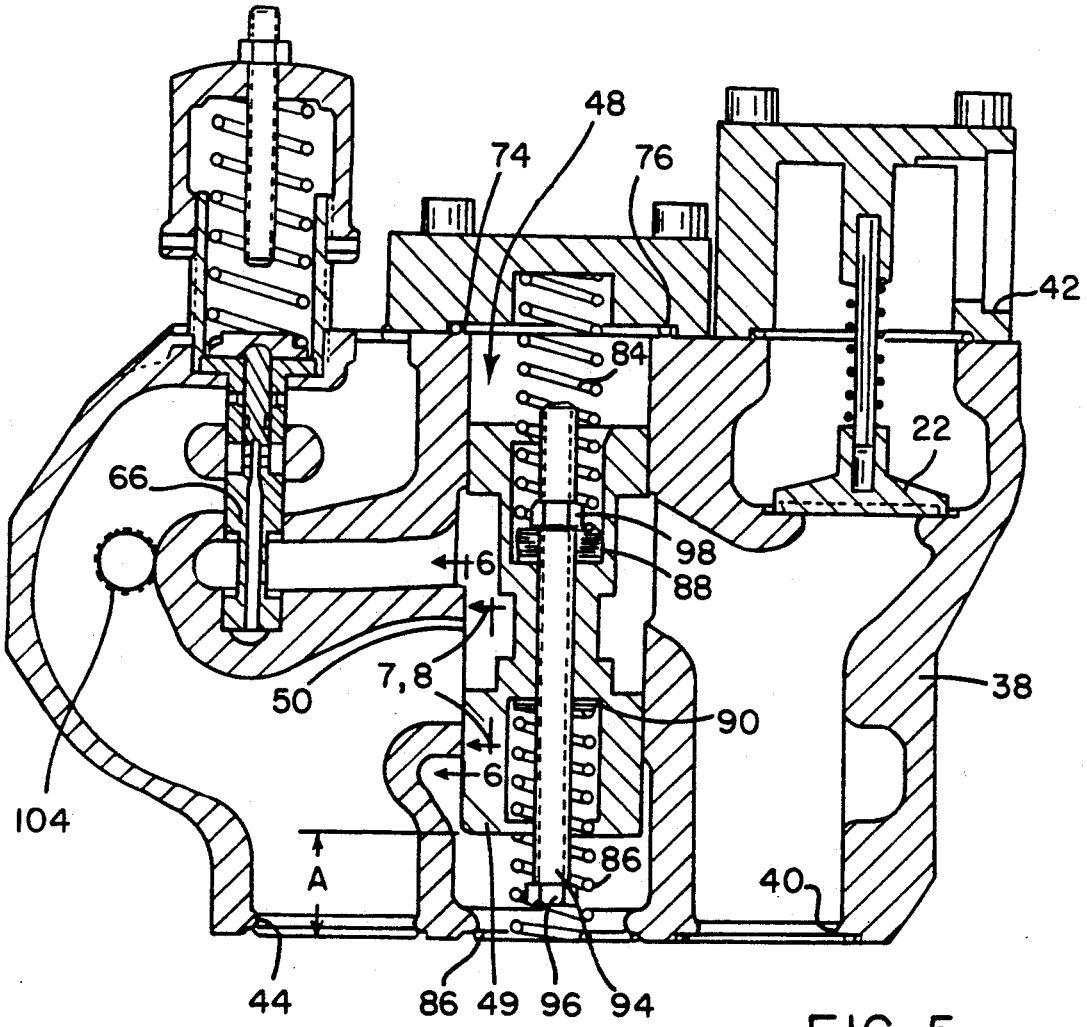
FIG. 5 is a cross-sectional view of the unloading valve of the invention.

It will further be appreciated that while the spool 49 travels through a range of positions during operation, it has three equilibrium positions, as illustrated in FIGS. 1–5. The spool 49 may be stationary when it is in its extreme downward position, as shown in FIGS. 1 and 2, when it is in its extreme upward, loaded position, as shown in FIGS. 3 and 4, or when it is in its "spring-biased" position, as shown in FIG. 5. In the broadest sense, both of the positions shown in FIGS. 1, 2, and 5, wherein the bypass port 50 is at least partially open, may be considered unloaded. When the motor 22 first is energized, the spool 49 will be in a spring-biased quiescent condition (as shown in the cross-sectional view of the valve 36 in FIG. 5), allowing fluid flow to the bypass outlet 44. Alternately, if the pump 20 is running in a continuous mode, the spool 49 will be disposed at a downward position, as shown in FIG. 1, where the solenoid 63 operated directional control valve 62 is in its de-energized position, directing inlet 40 pressure to the top of the spool 49. As a result, a very light load is placed on the pump 20 when it is running in its continuous mode.

If while the pump 20 is running in a continuous and unloaded condition, a signal is given to energize the solenoid 63 of the directional control valve 62, the pressure at the inlet 40 is redirected from the top to the bottom of the spool 49. As a result, the spool 49 begins to rise, closing off the bypass port 50. As the open area of port 50 becomes progressively restrictive, the pressure at the inlet 40 increases, which increases the operating force applied to the valve operator 48. As the spool 49 progresses toward its extreme upward position, sufficient pressure is developed within the valve 36 to begin opening the one-way check valve 28 to provide flow through the working outlet 42. As the port 50 becomes progressively restrictive and eventually fully closes off bypass flow, the one-way check valve 28 fully opens to allow full fluid flow to pass through the working outlet 42 to the load or accumulator 26, as shown in FIG. 3.

When flow to the high pressure load 26 is no longer required, as when normal pressure or a desired minimum is re-established in the accumulator tank, a signal is provided to de-energize the solenoid 63 operated valve 62 to restore it to the position shown in FIG. 4. Returning the directional valve 62 to its original position once again connects the valve inlet 40, and, therefore, the pump outlet 30, to the upper end of the spool 49 by way of lines 52 and 54, and further connects the bypass outlet 44 to the lower end of the spool 49 by way of lines 56 and 58. Consequently, the pressure is applied to the spool 49 ends such that the high pressure fluid from the pump outlet 30 flowing through the valve inlet 40 causes the valve operator 48 to return to the unloaded condition shown in FIG. 1. The resultant flow through the valve 36 to return to the bypass outlet 44, significantly reduces the load on the pump 20. When the piston 48 is in the fully unloaded position, the load on the pump 20 is greatly reduced and the motor 22 can be stopped to shut down the pump 20. Alternately, in a manual or continuous flow system the pump 20 can continue to run substantially unloaded until it is indicated that another cycle is required or until the fluid reaches a desired temperature level, as described below.

A cross-sectional view of the unloading valve 36 is shown in more detail in FIG. 5 wherein the components of the valve 36 correspond to those discussed above with reference to the schematics of FIGS. 1–4. While the lines 52, 54, 56, 58 that apply the pressure or operating force across the valve operator 48 are not illustrated in FIG. 5, those connections would be the same as in the schematics of FIGS. 1 through 4. The spool 49 is shown in a spring-biased quiescent position, as when there is no flow through the loading valve 36, as before the start of a pumping cycle. When the pumping cycle is initiated and as the pump 20 comes up to speed, the spool 49 rises to block the bypass port 50 to prevent flow to the bypass outlet 44. As a result, the fluid flows through the working outlet 42 to the high pressure load 26 (not shown in FIG. 5). When the solenoid 63 operated valve 62 (not shown in FIG. 5) reverses the pressure or operating force across the valve operator 48, the spool 49 moves downward to again allow flow to the bypass outlet 44, which reduces the load on the pump 20 so that the power supply to the pump 20 may be discontinued.

The unloading valve 36 is additionally provided with a relief valve 66 disposed along the outlet side of the valve operator 48. While the relief valve 66 may be set to allow fluid passage at any appropriate pressure, in a preferred embodiment of the invention, the pressure at which the relief valve 66 allows fluid passage may be set in a range between around 200 to 1650 psi. In one unit embodying the invention, the relief valve 66 pressure was preset at 590 psi. The relief valve 66 provides a safety feature by preventing pressure within the valve 36 from exceeding desired operating levels.

Further, to prevent rapid unrestricted movement of the spool 49, flow to and from at least one end of the valve operator 48 is restricted by an orifice assembly 68, as shown in FIGS. 1–4. While it will be appreciated that such assemblies could be provided to restrict the flow to and from either or both the chambers at the upper and lower ends of the valve operator 48, in a preferred embodiment of the invention, an orifice assembly 68 is disposed to control the flow of fluid to and from the upper end of the valve operator 48 as directed by the solenoid 63 operated directional valve 62.

According to a feature of the illustrated unloading valve 36, the unloading valve 36 may be adjusted to accommodate a wide range of flow capacities and pressures, and provide movement of the spool 49 at a desired differential pressure. In short, the same valve 36 can be configured to be fully functional in a small system where design flow rates are only 10 gpm, or in a substantially larger system where flow rates of 400 gpm are accommodated. Likewise, the valve 36 can accommodate a corresponding wide range of pressures. The valve 36 can accommodate pressures ranging from about 150 psi to 100 psi, or, in some cases, as high as 1650 psi. In accomplishing these features such that a single valve 36 may be configured to operate over a range of pressures and flow rates, no major mechanical changes in the valve body 38 itself as well as changes in various components utilized in the valve 36 are required. Rather, in order to configure a valve 36 that operates over a particular range of flow rates or pressures, the valve 36 has a number of possible initial setups. Inasmuch as this is a substantial flow range for the operation of a device of a single design, it will be appreciated that manufacturing, servicing and stocking of parts of the valve is greatly simplified in that a single valve body 38 and other related components may be utilized in a number of applications.

As explained in greater detail in copending application Ser. No. 602,717, filed Oct. 24, 1990, in order to adapt the valve 36 of the invention for different flow rates, the valve 36 may be set up so that the open area of the port 50 is of the appropriate size to result in spool 49 movement at 50 psi or other desired differential pressure for a given flow rate. In accomplishing this objective, the invention provides a particularly shaped port 50 design as well as means to adjust the extent to which the bypass port 50 will open during maximum flow through the unloading valve 36.

Figure 6:
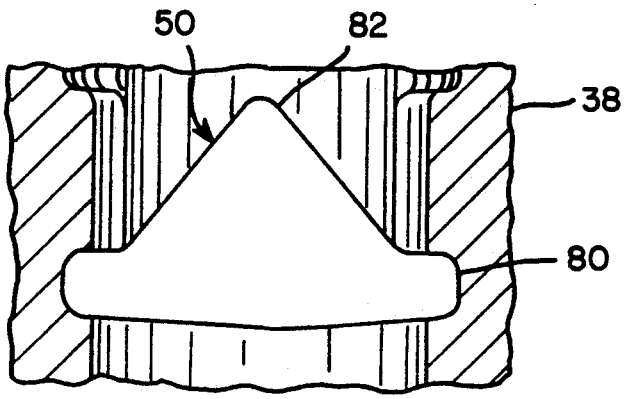
FIG. 6 is fragmentary view of the bypass port taken along line 6—6 in FIG. 5.

Turning first to the design of the bypass port 50, the port 50 has a shape that is particularly suited for passing a range of flows. The bypass port 50, which is shown in FIG. 6 has a large, substantially rectangular-shaped lower portion 80, and a substantially triangular-shaped upper portion 82. It will be appreciated that this particular port 50 shape is given by way of example, and that the port 50 may be of an alternate shape that likewise provides smooth transitional loading and unloading.

The spring-biased position of the spool 49 is determined by a system of centering springs 84, 86 and spacers 88, 90. Thus, in order to vary the area of the bypass port 50 that is open to fluid flow at pump 20 start up, the number of spacers (in this embodiment washers 88, 90 are used) and the spring 84, 86 biased gap A may be adjusted at initial setup of the valve 36.

At low flow rates, the unloader valve operator spool 49 may be set up to close off all of the large rectangular portion 80 of the bypass port 50, as shown in FIG. 7. In this way, the bypass flow is restricted to the triangular portion 82 of the port 50, which will generate the requisite pressure drop across the unloader valve operator 48 at a low flow rate. At higher flow rates, the spool 49 may be set up to allow the opening of a large portion of the rectangular-shaped port 80 as shown in FIG. 8. This allows a higher bypass flow rate to generate the same pressure drop across the valve 36.

A chart of representative flow related settings for the setup of the valve 36 in a preferred embodiment are shown in the chart identified as FIG. 9. It will be appreciated that the values given are by way of representation and not limitation. As shown in the chart, for a given flow rate in gallons per minute (gpm), a specified number of washers 88, 90 may be assembled with the unloader piston to achieve the specified gap identified as A in FIG. 5. Gap A represents the distance between the lower surface of the unloader valve operator spool 49 in its quiescent spring-biased position and a reference point, which is the lower surface of the valve body 38 in this embodiment. As shown in the chart of the FIG. 9, for low flow rate, such as 10–50 gallons per minute, the gap A is relatively large. Consequently, a majority of the large rectangular portion 80 of the bypass port is closed off by the spool 49 such that the flow through the bypass outlet 44 is restricted primarily to the triangular portion 82, as described above and shown in FIG. 7. Returning now to the chart of FIG. 9, it will be appreciated that the gap A is reduced at higher flow rates. This results in a larger opening of the rectangular-shaped portion 80 of the bypass port 50, as shown in FIG. 8 and explained above, allowing a higher bypass flow rate through the bypass outlet 44 for a given pressure drop across the port 50. Thus, valve 36 may be set up to provide a desired differential pressure across the valve 36 for either high or low flow rates, as shown in the chart. Each of the representative flow related setups shown in FIG. 9 will provide a 50 psi differential pressure for the given flow rates.

In accordance with an important aspect of the invention, the valve 36 may used to provide controlled heating of the hydraulic fluid. In order to provide such controlled heating, means are provided whereby the valve 36 permits flow therethrough at a relatively low pressure differential. In a preferred embodiment of the invention, the pressure differential is on the order of approximately 20 psi. In this way, the valve 36 may be adjusted to provide a second differential pressure by adjusting a stop to establish a minimum lower position for the unloader valve operator spool 49 when the valve 36 is operating in an unloaded condition shown in FIG. This stop includes a threaded rod 94, which extends through the spool 49. The lower bolt head 96 on the threaded rod 94 may be rotated to thread the rod 94 through the spool 49 and the upper bolt 98. During operation, the downward movement of the spool 49 will be limited when the lower bolt head 96 and the threaded rod 94 reach the base plate 86 of the valve 36 shown in FIG. 5, and schematically illustrated in FIG. This second differential pressure is especially useful to avoid oil heating problems when the pump 20 is being run continuously, as in the manual mode, for example in flow ranges of 10–400 gallons per minute. In this way, a low but controlled pressure drop may be established across the valve 36 when the pump 20 is running substantially unloaded.

According to accepted principles of fluid dynamics, flow through the valve 36 at this low, second differential pressure will yield a controlled heating of the fluid. The fluid, which is heated as it flows through the unloader valve 36, is returned to the sump 24. To ensure adequate mixing of the fluid, the sump 24 may be designed so that the heated fluid supplied from the valve 36 is forced to take a long, and perhaps circuitous, path before reaching the pump 20 suction or inlet. Flow through this long path also provides additional time for gases to escape from the fluid. Further, to reduce undesirable frothing, the fluid may be introduced into the sump 24 below the fluid level.

Figure 10:
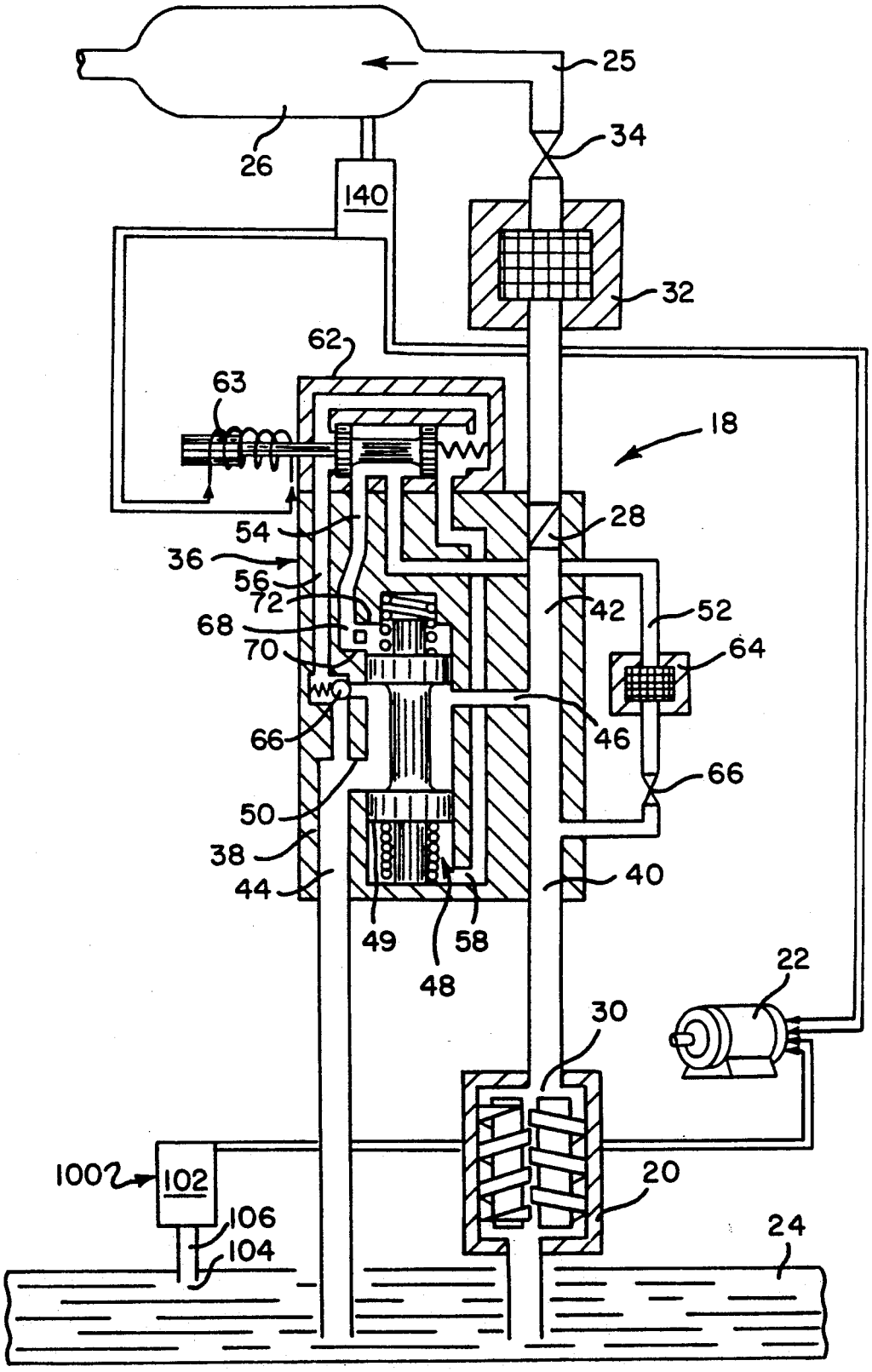
FIG. 10 is a schematic view of an alternate embodiment of the hydraulic fluid supply system.

When the loading system 18 is in an automatic or cyclic mode and the valve 36 is in the unloaded position shown in FIG. the spool 49, which is disposed in the lower-most position permitted by the lower bolt head 96 and rod 94, allows flow through the valve 36 to the bypass outlet 44. In order to monitor the temperature of the fluid, a temperature sensing device 100 is provided. It will be appreciated that the sensing device 100 may be disposed at any appropriate location to monitor the temperature of the fluid in the system 18. In the embodiment shown in FIGS. 1–5, for example, the temperature sensing device 100 is disposed along the bypass side of the valve 36 to monitor the temperature of fluid flowing through the bypass outlet 44. This location is particularly advantageous in that the temperature sensing device 100 may be conveniently provided as an integral part of the unloader valve 36. Alternately, the temperature sensing device 100 could include a pipe with a pipe well that extends down into the sump 24 to provide a direct reading of the temperature of the fluid in the sump 24. (This embodiment is not shown in the figures.) The temperature sensing device 100 may alternately, and perhaps more efficiently be disposed to directly read the temperature of the fluid in the sump 24, as shown in FIG. 10. In this way, the effects on the temperature sensing device 100 due to the temperature of the valve body 38 itself or other components of the system may be minimized.

The temperature sensing device 100 is coupled to the pump 20 such that the power supply to the pump 20 is discontinued when the temperature of the fluid is within a desired temperature range. The temperature sensing device 100 may be of any appropriate design. In a preferred embodiment of the invention, the temperature sensing device 100 is a proximately located temperature switch or a remotely disposed temperature switch 102 having a thermal element, such as a bulb 104 and a capillary 106, that automatically senses a change in temperature and opens or closes an electrical switch when the fluid reaches a predetermined temperature. The temperature switch 102 may incorporate a compensating device to cancel out the adverse effects of ambient fluctuations in the fluid temperature and may be adjustable to allow for changes in the actuation points. In the preferred embodiment of the invention, the temperature sensing device 100 incorporates a single thermal element 104, 106, and two independently adjustable switches 102 that open the electrical contact when the oil reaches a desired high temperature to discontinue power to the pump 20 and close the electrical contact when the oil is at a temperature lower than the desired temperature range. In this way, when the fluid temperature is lower than the temperature required to provide a desirable viscosity level, power will be supplied to the pump 20 so that fluid circulates through the unloading valve 34 to heat the fluid. When the circulating fluid reaches the temperature required to provide the desired viscosity level, power to the pump 20 is discontinued to cease the circulation and the heating of the fluid by flow through the valve 34.

Figure 11:
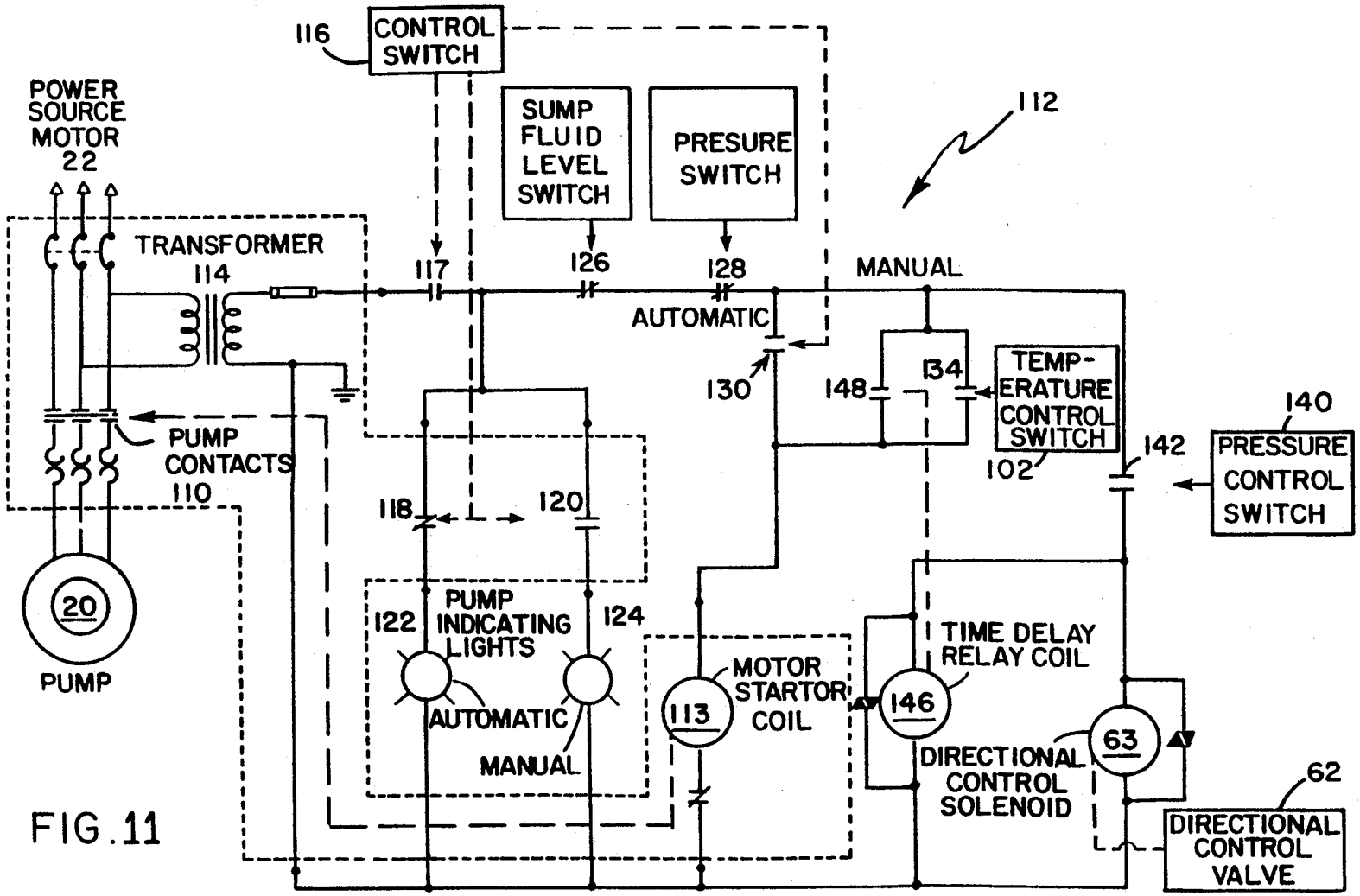
FIG. 11 is a representation of the electrical control system of the hydraulic fluid supply system.

Overall operation of the system 18 may be described with reference to the electrical control system shown in FIG. 11. A motor 22 provides operating power to the pump 20 through electrical contacts 110 when the contacts 110 are in the closed position. The power source 22 likewise supplies power to the control system, which is generally designated as 112. It will be appreciated by those skilled in the art that when appropriate control contacts are closed and the motor starter coil 113 is energized, electrical contacts 110 will be closed to supply power to the pump 20.

A transformer 114 may be disposed between the power source 22 and the control system 112 to provide an isolated control voltage supply, if so desired. In a preferred embodiment of the invention, a voltage of 480 volts from a three-phase, sixty Hz motor 22 is dropped to 115 volts to power the control system 112. The system 112 is provided with a control switch 116, which operates contact 117, having "OFF," "AUTOMATIC," and "MANUAL" modes. When the switch 116 is in the "AUTOMATIC" mode, the system 18 will run in the cyclic mode. When the switch 116 is in the "MANUAL" mode, the system 18 will run continuously. Thus, when the control switch 116 is in the "OFF" position, contact 117 will be in the open position. Conversely, contact 117 will be in the closed position when the control switch 116 designates the "AUTOMATIC" or "MANUAL" modes. Auxiliary contacts 118, 120 may be provided to supply power to pump indicating lights 122, 124, which indicate whether the pump 20 is operating in the "AUTOMATIC" or "MANUAL" mode.

The control system 112 may likewise provide safety contacts to prevent conditions that would potentially result in a malfunction of the supply system 18. For example, the system 112 may include a normally closed contact 126 that opens to discontinue the supply of power to the pump 20 when the fluid level in the sump 24 falls below a desired level, or a normally closed pressure switch 128 that opens to likewise discontinue the supply of power to the motor 20 when the system 18 reaches the pressure at which the pressure switch 128 is set to operate. Any suitable pressure-sensing element may be utilized in the pressure switch 128. For example, bourdon tube type elements, sealed piston type elements, and dia-seal piston type elements may be particularly appropriate because of their operating ranges.

During operation, when the control switch 116 is in the "MANUAL" mode, contacts 117 and 130 will be closed. As a result, the motor starter coil 113 will be energized, contacts 110 closed, and the pump 20 will run continuously, as explained above. Alternately, if the control switch 116 is in the "AUTOMATIC" mode, the motor starter coil 113 may be energized, and, therefore, the contacts 110 closed in order to supply power to the motor 20, if the temperature of the fluid falls below a desired level, or the pressure in the accumulator 26 drops below a desired level, as explained above.

Turning first to the temperature control system, a temperature switch 102 is disposed in the unloading system 18 to automatically sense a change in the temperature of the hydraulic fluid. When the temperature falls below a desired level, the temperature switch 102 closes contact 134 to energize the motor starter coil 113, close contacts 110 and supply power to the motor 20. Conversely, when the temperature exceeds a desired level, the temperature switch 102 opens contact 134 to de-energize the motor starter coil 113, open contacts 110, and discontinue the supply of power to the motor 20.

Power may likewise be supplied to the pump 20 when a pressure switch 140 senses a low pressure condition in the accumulator 26. As indicated with respect to pressure safety contact 128, the pressure switch 140 may utilize any appropriate pressure-sensing element. Again, bourdon tube type sensing elements, sealed piston type sensing elements, and dia-seal piston type sensing elements may be particularly suited for this application because of the ranges of pressures at which they operate. When the pressure switch 140 senses a low pressure condition, it closes pressure contact 142, and when the desired pressure is restored, the switch 140 opens contact 142.

When the pressure contact 142 is closed, solenoid 63 operated directional control valve 62 is energized to transfer the valve 62 to its second position, illustrated in FIG. 2. Further, time delay relay coil 146 (which includes a delay on de-enerization) is energized to close contact 148 and immediately energize the motor starter coil 113, to close contacts 110, and supply power to the pump 20. As a result, the unloading valve 36 will move to a loaded condition and the accumulator 2 will ultimately be supplied with high pressure fluid, as explained above in detail with respect to FIGS. 1–3.

When the pressure switch 140 senses that the accumulator 26 has been restored to a desired pressure level, it opens the pressure contact 142 to deenergize the solenoid 63 and return the directional control valve 62 to its original position, as shown in FIG. 4. The unloading valve 36 subsequently returns to its unloaded condition. In order to allow the unloading valve 36 to fully return to the unloaded condition, shown in FIG. 1, before contacts 110 are opened and the power supply to the motor 20 interrupted, the time delay relay coil 140 continues to hold the contact 148 closed so that power to the motor 20 is not immediately discontinued. In this way, operation of the time delay relay coil 140 prevents undesirable shock to the hydraulic loading system 18 in that the unloading valve 36 has sufficient time to return to the unloaded condition before power to the pump 20 is discontinued. In a preferred embodiment of the invention, this delay time, though adjustable from 0.5 to 15 seconds, is set to allow the pump 20 to continue to operate for a few seconds after pressure contact 142 opens so that optimum performance of the system may be obtained.

In summary, the invention provides a system for and a method of establishing and maintaining fluid at desired viscosity and temperature levels in a hydraulic fluid system. The system includes a driven pump 20 that circulates fluid from a fluid supply 24 through a hydraulic loading system 18 that includes an unloading valve 36. As fluid flows through the valve 36, a pressure drop is created across the valve operator 48. As a result, the temperature of the fluid flowing through the valve 36 to the sump 24 increases, thus increasing the temperature of the fluid in the sump 24. During operation of the system 18, if a low temperature condition is sensed in the system 18, power will be supplied to the pump 20, which will pump fluid through the valve 36 at a controlled low pressure drop to result in a controlled heating of the fluid. When the fluid is restored to a desired temperature level, power to the pump 20 is interrupted to terminate flow through the valve 36. The level of heat produced in the fluid may be adjusted by adjusting the degree that the pressure drops as the fluid flows through the valve 36. This is accomplished by adjusting the degree of the restriction to flow across the valve operator 48. Thus, the unloader valve 36 is utilized as an efficient and economical means of controlling the temperature of the fluid in the system.

I claim as my invention:

1. A flow loading unloader valve for controlling fluid flow and fluid viscosity in a closed hydraulic system, the hydraulic system having a pump for producing high pressure fluid for supply to an accumulator, and a sump supplying the pump, the flow loading unloader valve being interposable in the system in line between the pump and the accumulator and requiring only an additional fluid connection to the sump and electrical connection to the pump, and comprising, in combination:

a valve body having an inlet connected to the pump, a working outlet connected to the accumulator, and a bypass outlet connected to the sump, a valve operator in the body having a loaded and an unloaded condition for controlling bypass flow between the inlet and the bypass outlet, the valve operator being adapted to present a light load to the pump in the unloaded condition, means responsive to a pressure drop across the valve when the valve operator is in the unloaded condition for switching the valve operator to the loaded condition, a check valve in the body interconnecting the inlet and the outlet and adapted to pass fluid flow to the accumulator when the pressure at the inlet is at a predetermined level greater than the pressure in the accumulator, a relief valve in the body interconnecting the inlet and the bypass outlet and adapted to open when the inlet pressure reaches a predetermined overload valve, means for monitoring the temperature of the fluid and comparing the temperature to a predetermined temperature range that provides a desired viscosity, and means for supplying power to the pump when the temperature is below the range and disconnecting the supply of power to the pump when the temperature is above the desired range, whereby the flow loading unloader valve accomplishes the functions of controlling fluid viscosity, loading, checking and relief while requiring fluid connections only to the pump, outlet and sump of the hydraulic system.

2. A method of operating an unloading valve in a closed hydraulic system to controllably impose a high pressure load on a pump to supply high pressure fluid to an accumulator and to control fluid viscosity, the unloading valve having an inlet from the pump, a working outlet that directs fluid flow to the accumulator when the valve is in a loaded condition, a bypass outlet that returns fluid to a sump when the valve is in an unloaded condition, a valve operator, and a bypass port interposed between the inlet and the bypass outlet, the method comprising the steps of:

sensing the pressure in the accumulator, transferring the valve to the loaded condition in which the bypass port is closed by the valve operator when low pressure in the accumulator is sensed to load the pump, pumping fluid from the sump through the valve in the loaded condition to the accumulator, transferring the valve to an unloaded condition in which the bypass port is open to flow when pressure is restored in the accumulator to unload the pump, sensing the temperature of the fluid, comparing the sensed temperature with a predetermined temperature range which provides a desired viscosity, pumping fluid from the sump through the valve in the unloaded condition and back to the sump, the bypass port restricting flow to the bypass outlet to result in a pressure drop across the bypass port which heats the fluid, discontinuing pumping when the sensed temperature is within the range.

3. A method of controlling the viscosity of hydraulic fluid and controllably imposing a high pressure load on a pump in a closed high pressure hydraulic system using an unloader valve, the system having a sump containing hydraulic fluid, a high pressure load, and a bypass circuit, the unloader valve being interposed between the pump, the load, and the bypass circuit and having an inlet, a working outlet, a bypass outlet, a valve operator, and a bypass port interposed between the inlet and the bypass outlet, the method comprising the steps of:

supplying power to the pump, transferring the valve operator to a loaded position in which the bypass port is closed to load the pump when the high pressure load demands fluid flow from the sump, pumping hydraulic fluid from the sump through the valve inlet and the valve working outlet to the high pressure load, transferring the valve operator to an unloaded position in which the bypass port is substantially open to unload the pump when the high pressure load demands no fluid flow, measuring the temperature of the hydraulic fluid as a measure of fluid viscosity, pumping hydraulic fluid from the sump through the valve inlet, the bypass port, and the bypass outlet to the bypass circuit back to the sump when the high pressure load demands no fluid flow and the fluid viscosity is higher than a predetermined level, restricting the flow of fluid through the valve by means of the bypass port to raise the temperature of the hydraulic fluid as it traverses the bypass circuit, and discontinuing the supply of power to the pump when the high pressure load demands no fluid flow and the viscosity is at the predetermined level.

4. A method as claimed in claim 3 further comprising the steps of comparing the measured temperature with a predetermined temperature range, and supplying power to the pump when the measured temperature is lower than the predetermined temperature range.

5. A method as claimed in claim 3 further including the step of mixing the fluid pumped through the valve with the fluid in the sump by forcing the fluid through a long flow path to mix and equalize the temperature of the fluid before the fluid is supplied to the pump.

6. The method as claimed in claim 3 wherein the step of restricting the flow by means of the bypass port in the unloader valve results in a small but effective pressure drop across the bypass port which raises the temperature of the hydraulic fluid.

7. A method as claimed in claim 6 including means for adjusting the size of the bypass port opening to attain a desired pressure drop.

8. A method as claimed in claim 3 further comprising the step of supplying power to the pump when the high pressure load demands no fluid flow and the temperature is lower than a predetermined level.

9. A method as claimed in claim 7 wherein the adjusting means comprises a stop in the valve to limit travel of the valve operator in the valve.

10. A method as claimed in claim 7 wherein the pressure drop is on the order of about 20 psi.

11. A method as claimed in claim 3 wherein the step of measuring is accomplished by providing a temperature sensing device coupled to the pump to control the supply of power.

12. A method as claimed in claim 11 wherein the temperature sensing device senses the temperature of the fluid in the sump.

13. A method as claimed in claim 11 wherein the temperature sensing device senses the temperature of the fluid flowing through the bypass circuit.

14. The method as claimed in claim 3 wherein the valve operator is disposed in a start-up position before power is supplied to the pump, such that a start-up pressure drop is created across the bypass port when power is supplied to the pump.

15. The method as claimed in claim 14 including means for adjusting the start-up position of the valve operator to provide a desired start-up pressure.

16. The method as claimed in claim 15 wherein the means for adjusting the start-up pressure includes springs and spacers disposed in line with the valve operator.

17. A flow system utilizing an unloading valve to control viscosity and to controllably impose a high pressure load on a pump, the system comprising:

a fluid supply, a power supply which supplies power to the pump to pump fluid from the fluid supply through the valve, the unloading valve having an inlet connected to the pump, a working outlet connected to the high pressure load, a bypass outlet connected to the fluid supply, a bypass port interposed between the inlet and the bypass outlet, and a valve operator to control the degree of opening of the bypass port, the valve having a loaded position in which the bypass outlet is closed and the valve supplies high pressure fluid flow to the load through the working outlet and an unloaded position in which the bypass outlet is substantially open and the valve supplies fluid flow to the bypass outlet through the bypass port, the degree of opening of the bypass port presenting a restriction to flow through the bypass outlet, wherein there is a lower pressure differential created across the valve due to the restriction to flow, a temperature sensor disposed to determined the temperature of the fluid when the valve is operating in an unloaded position, means for comparing the sensed temperature to a predetermined temperature range which provides a desired viscosity, and means for coupling the temperature sensor to the pump to discontinue the supply of power to the pump when the temperature of the fluid reaches a temperature within the predetermined range and the high pressure load does not require fluid.

18. A flow system as claimed in claim 17 wherein the coupling means provides a signal to supply power to the pump when the temperature of the fluid drops below the predetermined range.

19. A flow system as claimed in claim 17 wherein the temperature sensor is disposed to determine the temperature of the fluid flowing through the valve.

20. A flow system as claimed in claim 17 wherein the temperature sensor is disposed to determine the temperature of the fluid within the fluid supply.

21. A flow system as claimed in claim 17 wherein the pressure differential is on the order of 20 psi.

22. A flow system as claimed in claim 17 wherein the fluid supply comprises means for mixing the fluid pumped through the valve with the fluid in the fluid supply to equalize the temperature of the fluid before the pump pumps fluid from the supply.

23. A flow system as claimed in claim 22 wherein the means for mixing comprises a long flow path.

24. A flow system as claimed in claim 22 comprising means for introducing the fluid pumped through the valve into the fluid supply below the level of the fluid in the fluid supply.

25. A flow system as claimed in claim 17 comprising means to adjust the pressure differential.

26. A flow system as claimed in claim 25 wherein the means to adjust the pressure differential comprise a stop in the valve to limit travel of a piston in the valve.

27. The flow system as claimed in claim 17 wherein the unloading valve has a start-up condition wherein the valve operator partially closes the bypass port before power is supplied to the pump such that a start-up pressure drop is created across the bypass port when power is supplied to the pump.

28. The flow system as claimed in claim 27 further including means for adjusting the start-up position of the valve operator to provide a desired start-up pressure.

29. The flow system as claimed in claim 28 wherein the means for adjusting the start-up pressure includes springs and spacers disposed in line with the valve operator.

30. A method of using an unloading valve to control viscosity and to controllably impose a high pressure load on a pump, the unloading valve being interposed between the pump, a high pressure load, and a bypass circuit, the unloading valve having an inlet, a working outlet, a bypass outlet, a valve operator, and a bypass port interposed between the inlet and the bypass outlet, the method comprising the steps of:

supplying power to the pump, pumping fluid from a fluid supply to operate the valve in a loaded condition in which the valve operator closes the bypass port to load the pump to drive the high pressure load when the high pressure load demands fluid flow from the fluid supply, switching the valve to a heating mode when the high pressure load does not demand fluid flow from the fluid supply wherein the valve unloads the pump and operates in an unloaded condition in which the valve operator opens the bypass port, the degree of opening of the bypass port presenting a restriction to flow across the valve operator, wherein the valve operates with a lower pressure differential across the bypass port, monitoring the temperature of the fluid as a measure of fluid viscosity when the unloader valve is in the heating mode, and discontinuing the supply of power to the pump when the temperature indicates that the viscosity is at a predetermined desired level.

31. A method as claimed in claim 30 wherein the pressure differential is on the order of about 20 psi.

32. A method as claimed in claim 30 further comprising the steps of comparing the temperature monitored with a predetermined temperature range, and supplying power to the pump when the temperature monitored is lower than the range and discontinuing the supply of power to the pump when the temperature monitored is above the range.

33. A method as claimed in claim 30 wherein the monitoring step is accomplished by monitoring the temperature of fluid flowing through the valve.

34. A method as claimed in claim 30 wherein the monitoring step is accomplished by monitoring the temperature of fluid in the fluid supply.

35. The method as claimed in claim 30 wherein the unloading valve has a start-up condition wherein the valve operator partially closes the bypass port before power is supplied to the pump such that a start-up pressure drop is created across the bypass port when power is supplied to the pump.

36. A method as claimed in claim 30 further comprising the step of adjusting the degree of opening of the bypass port to provide a desired pressure differential.

37. A method as claimed in claim 36 wherein the adjusting step is accomplished by adjusting a stop in the valve to limit travel of the valve operator in the valve.

* * * * *

UNITED STATES PATENT AND TRADEMARK OFFICE

CERTIFICATE OF CORRECTION

PATENT NO. :5,118,259

DATED :June 2, 1992

INVENTOR(S) :David R. Bishoff

It is certified that error appears in the above-identified patent and that said Letters Patent is hereby corrected as shown below:

Title Page:

[57] ABSTRACT

Line 19 of the abstract "flow" should read -- flows --.

Column 4, line 6 add the number "1" after the second "FIG.";

UNITED STATES PATENT AND TRADEMARK OFFICE

CERTIFICATE OF CORRECTION

PATENT NO. : 5,118,259

DATED : June 2, 1992

INVENTOR(S) : David R. Bishoff

It is certified that error appears in the above-identified patent and that said Letters Patent is hereby corrected as shown below:

Column 6, line 37 delete "form" and substitute therefor -- from --;

Column 6, line 59 after the word "will" add -- be --;

Column 9, line 29 delete "100" and substitute therefor -- 1100 --;

UNITED STATES PATENT AND TRADEMARK OFFICE

CERTIFICATE OF CORRECTION

PATENT NO. : 5,118,259

DATED : June 2, 1992

INVENTOR(S) : David R. Bishoff

It is certified that error appears in the above-identified patent and that said Letters Patent is hereby corrected as shown below:

Column 10, line 56 after the word "FIG." add -- 1 --;

Column 10, line 64 after the second "FIG." add -- 1 --;

Column 11, line 19 after the word "FIG." add -- 1 --;

Column 13, line 32 delete "2" and substitute therefor -- 26 --; and

Column 13, line 37 delete "deenergize" and substitute therefor -- de-energize --.

UNITED STATES PATENT AND TRADEMARK OFFICE

CERTIFICATE OF CORRECTION

PATENT NO. : 5,118,259

DATED : June 2, 1992

INVENTOR(S) : David R. Bishoff

It is certified that error appears in the above-identified patent and that said Letters Patent is hereby corrected as shown below:

Column 16, line 64 delete "lower" and substitute therefor -- low --.

Signed and Sealed this

Fifth Day of October, 1993

Bruce Lehman

*Attest:*

BRUCE LEHMAN

*Attesting Officer*

*Commissioner of Patents and Trademarks*